United States Patent [19]

Otema

[11] Patent Number: 4,460,093

[45] Date of Patent: Jul. 17, 1984

[54] SECURITY DEVICE

[76] Inventor: Martin Otema, 51 Pine Ridge Dr., Scarborough, Ontario, Canada, M1M 2X6

[21] Appl. No.: 426,479

[22] Filed: Sep. 29, 1982

Related U.S. Application Data

[63] Continuation-in-part of Ser. No. 291,877, Aug. 11, 1981, , which is a continuation-in-part of Ser. No. 179,797, Aug. 20, 1980, abandoned.

[51] Int. Cl.[3] ..... A47F 5/00

[52] U.S. Cl. ..... 211/4; 70/59

[58] Field of Search ..... 211/4, 7, 8, 162; 70/57, 58, 59, 61, 62, 18

[56] References Cited

U.S. PATENT DOCUMENTS

| | | | |
|---|---|---|---|
| 699,971 | 5/1902 | Poschmann | 211/124 |
| 2,460,997 | 2/1949 | Myers | 211/162 X |
| 3,690,130 | 9/1972 | Eutzler | 211/4 X |
| 3,985,183 | 10/1976 | Fernbaugh | 211/7 |
| 4,069,691 | 1/1978 | Simpson | 211/4 X |
| 4,069,919 | 1/1978 | Fernbaugh | 211/4 |
| 4,123,922 | 11/1978 | Kuenstler | 211/4 X |
| 4,212,175 | 7/1980 | Zakon | 70/58 |
| 4,221,298 | 9/1980 | Wright et al. | 211/4 |
| 4,260,063 | 4/1981 | Bennett et al. | 211/4 |

FOREIGN PATENT DOCUMENTS

| | | | |
|---|---|---|---|
| 777489 | 6/1957 | United Kingdom | 70/61 |

*Primary Examiner*—Ramon S. Britts
*Assistant Examiner*—Robert W. Gibson, Jr.
*Attorney, Agent, or Firm*—Rogers, Bereskin & Parr

[57] ABSTRACT

A security device is disclosed and is designed to allow articles secured by the device to be manipulated while remaining effectively secured. The device is particularly useful for securing articles of clothing which are required to be available for examination and trying on but which must be effectively secured to prevent theft. The device includes a plurality of flexible elongate elements each adapted to retain at least one article to be secured and an anchor member for the elements. The elements are releaseably secured in an elongate slot in the anchor member and a lock is provided for preventing unauthorized release of the flexible elements.

9 Claims, 9 Drawing Figures

SECURITY DEVICE

This application is a continuation-in-part of application Ser. No. 291,877 filed Aug. 11, 1981 which is itself a continuation-in-part of application Ser. No. 179,797 filed Aug. 20, 1980 now abandoned.

The present invention relates generally to a security device designed to allow articles secured by the device to be manipulated while remaining effectively secured. A device of this kind is particularly useful in, for example, clothing stores in which articles are required to be available for examination and trying on.

Numerous prior art devices are known for preventing the theft of articles on display for the purposes of sampling, inspecting and trying on. For the most part, these devices are effective for their intended purposes; that is, they do permit merchants to display their wares in a relatively safe manner so as to enable prospective purchasers to inspect them without undue fear of theft. However, the means employed in most of these known devices for preventing theft are cumbersome and inconvenient to use. For example, an anti-theft display device sold by Securax, Inc. of Fort Worth, Tex. includes a garment hanger supporting means characterized by a rather complicated lock-controlled hinged mechanism for securing and unsecuring a displayed garment. A similar device is disclosed in U.S. Pat. No. 4,204,601 (Thomas).

According to the present invention there is provided a security device which includes a plurality of flexible elongate elements each adapted to retain at least one article to be secured and an anchor member for said elements, the anchor member being adapted to be secured in a fixed position and including an elongate undercut slot extending longitudinally of the member. The flexible elements having first end portions serially disposed in the slot, with the remainder of each element extending outwardly from the member and being of a length sufficient to permit the articles to be individually manipulated with respect to the member while remaining secured thereto by the flexible elements. Each said element has an enlargement at its first end and the slot in the anchor member is dimensioned to permit free sliding movement of the flexible elements along the slot while preventing movement of the enlargements through the slot. The anchor member further includes a release opening which communicates with the slot and which is of a size sufficient to permit movement of any of the enlargements therethrough so that the associated elongate element can be released from the anchor member. The device also includes lock means coupled to the housing and including a lock member movable between a locking position in which the member prevents movement of the elements from the slot to the release opening, and a release position permitting such movement of the elongate elements. The lock means is releasable to permit movement of the lock member to the release position when authorized removal of articles is to be permitted.

In a preferred embodiment of the invention the device is incorporated in a display stand including a base; an upright member supported on the base and perpendicular thereto and a hollowed out support member extending outwardly from the upright member preferably, but not necessarily, at right angles thereto and generally parallel to the base, for supporting at least one clothes hanger; and means associated with the support member or the upright member for partially removably securing an article to said support member.

The means for partially, removably securing the article may comprise a thin, flexible cable of preselected length having an article retaining member fixed to a first end thereof, said article retaining member being of a size larger than an aperture, for example, a buttonhole in said article so as to prevent removal of the article from said first end of the cable when the cable is passed through said aperture. The other end of the cable is provided with a stop member which is smaller than the aperture in the article. Thus, the only way in which the article can be completely disassociated from the cable is by passing the stop member through the aperture. In one embodiment, the means for partially, removably securing the article further includes a channel provided in one surface of the support member, said channel being of a width that is less than the size of the stop member and terminating at one end thereof in a region which is of a larger size than the stop member. Thus, the stop member, and the cable to which it is attached is freely movable along the entire length of the channel but is only able to be disengaged or removed from the support member when the stop member is in the region of larger size. The means for partially removably securing the article further comprises a stop member restraining element mounted in a surface adjacent and at right angles to said one surface, said restraining element comprising a lockable bar movable between secure and free positions in which said bar, in its secure position prevents the movement of the stop member into the region of larger size and which in its free position permits the stop member to enter the region of larger size so as to enable the stop member and the cable to which it is attached to be completely disengaged from the support member.

In another embodiment, the means for partially securing the article further includes a channel provided in one surface of the upright member, said channel being of a width that is less than the size of the stop member and terminating at one end thereof in a region which is of a larger size than the stop member. Thus, the stop member, and the cable to which it is attached is freely movable along the entire length of the channel but is only able to be disengaged or removed from the upright member when the stop member is in the region of larger size. The means for partially removably securing the article further comprises a stop member restraining element mounted in a surface adjacent and at right angles to said one surface, said restraining element comprising a lockable bar movable between secure and free positions in which said bar, in its secure position prevents the movement of the stop member into the region of larger size and which in its free position permits the stop member to enter the region of larger size so as to enable the stop member and the cable to which it is attached to be completely disengaged from the upright member.

The invention will now be more particularly described with reference to the accompanying drawings, in which.

Figure 1:
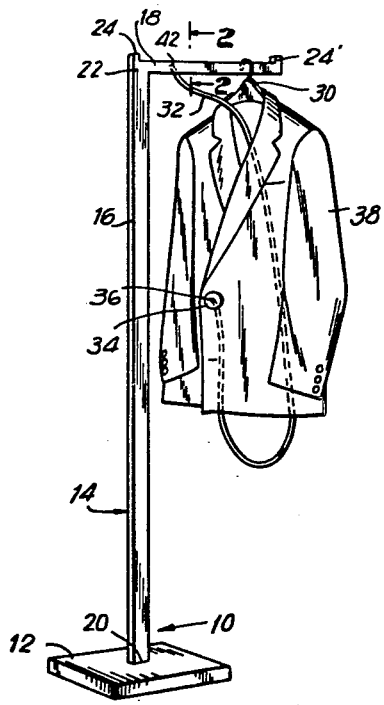
FIG. 1 is a perspective view of a garment rack incorporating a security device according to the invention.
Figure 2:
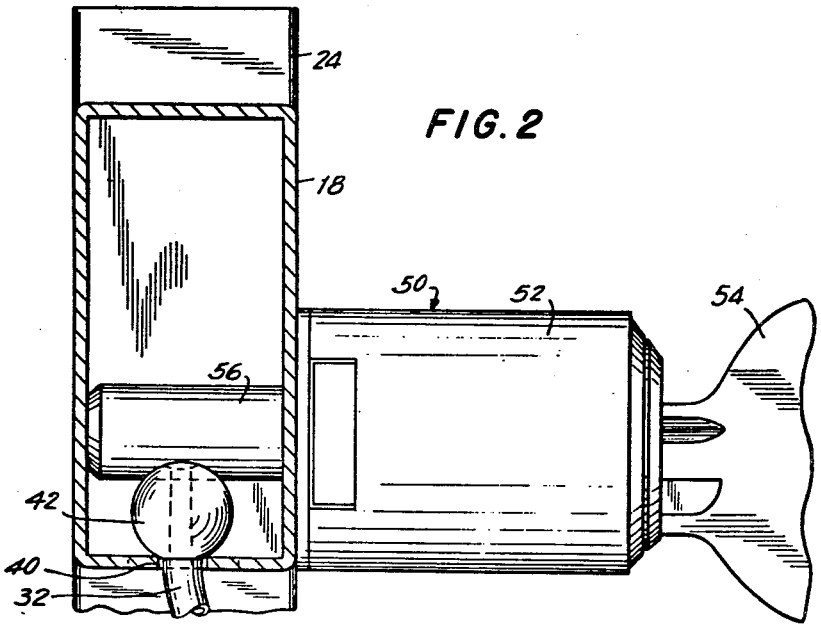
FIG. 2 is an enlarged cross-sectional view taken along line 2—2 of FIG. 1.

Referring now to FIG. 1, a security display device is generally indicated by reference numeral 10. The device 10 includes a rectangular, preferably hollowed-out, base 12 to which is connected a stand 14 of rectangular cross-section supported thereon. While base 12 is shown as rectangular, it can, of course assume any other convenient configuration. Thus, it may be triangular in shape as well as a more elongated rectangular shape so as to have more than one stand 14 supported thereon. Additionally, base 12 may assume a non-solid configuration such as a pair of cross legs, for example, at right angles to one another. Stand 14 includes upright member 16 and support member 18, and is connected at its bottom end 20 to base 12 in any convenient manner. For example, it may be secured by means of a bolt and nut arrangement or the like. Upright member 16 of stand 14 may be of any convenient length, but preferably, is of sufficient length so that when base 12 rests upon the floor, an article displayed on the device is at a convenient height for sampling by a prospective purchaser.

Upright member 16 and support member 18 are conveniently made of tubular steel (although other materials as well may be used). Upright member 16 and support member 18 may be connected to each other by any convenient means. Preferably, they are welded together It is not essential that upright member 16 be hollow, but for cost and weight reasons it obviously should be hollow. On the other hand, support member 18 must be hollow because of certain structural requirements of the invention that will become apparent later.

The end region 22 of upright member 16 is provided with a shoulder 24 at the edge thereof remote from the edge to which support member 18 is connected. Shoulder 24 corresponds in size to a similar shoulder 24' provided at the free end of support member 18. Shoulders 24 and 24' together serve to prevent a clothes hanger 30 supported on support member 18 from sliding off the support member 18.

The means for partially, removably securing an article of clothing to the device of the invention includes a thin flexible cable 32, preferably made of a flexible metal covered with a plastic material, to one end of which is secured a disc 34, preferably of a clear plastic such as lucite. The size, or diameter of disc 34 should be large enough to prevent its passage through a button hole 36 in an article of clothing 38. The length of cable 32 should be great enough so that when cable 32 is passed through buttonhole 36 of clothing 38 and the other end of cable 32 is secured to support member 18 (in a manner to be described below), there is enough "play" in the cable to permit a prospective purchaser to remove clothing 38 from hanger 30 and try it on without completely freeing clothing 38 from the device 10.

Figure 3:
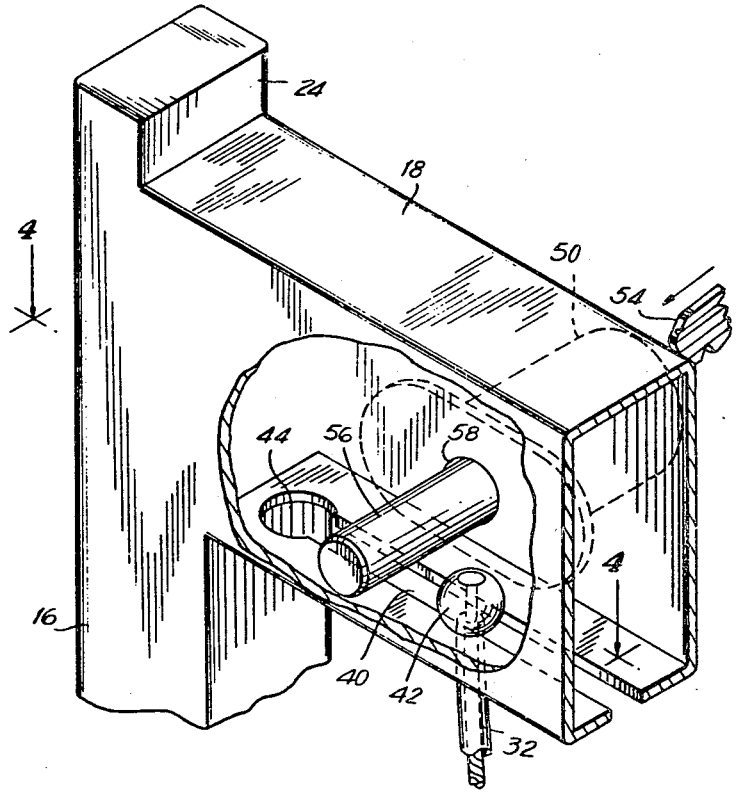
FIG. 3 is an enlarged, partially broken-away, perspective view of a portion of the rack shown in FIG. 1.
Figure 4:
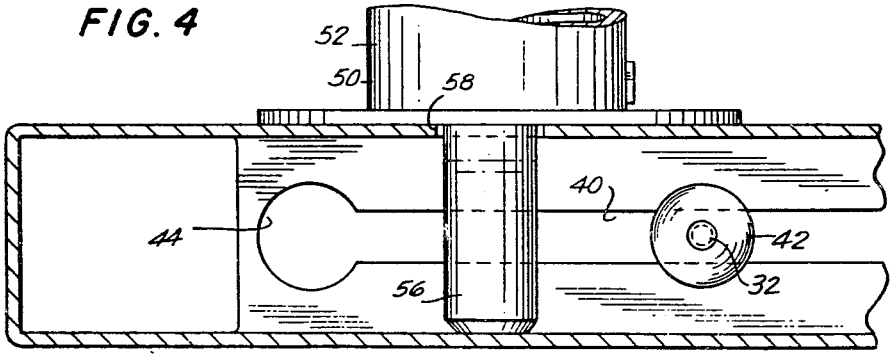
FIG. 4 is an enlarged bottom plan view of a portion of the rack shown in FIG. 1.

As best shown in FIGS. 3 and 4, the underside of support member 18 is provided with a channel 40 which runs for substantially the entire length of member 18. The other end of cable 32 has connected to it a stop member 42, which is preferably a small metal ball whose diameter is greater than that of cable 32. The end 44 of channel 40 remote from the free end of member 18 terminates in a region of greater size than stop member 42.

Near the end of support member 18 having the region of greater size 44 of channel 40, member 18 is provided, on a surface adjacent that in which channel 40 is located, a locking device generally shown by reference numeral 50. Locking device 50 includes a spring loaded lock 52 operable by key 54 to move locking bar 56 between open and closed positions. As shown in the drawings, locking bar 56 is in the closed portion. Locking bar 56 is movable into and out of the body of lock 52 through aperture 58 provided in said surface. When locking bar 56 is in its closed position as shown in the drawing, it prevents stop member 42 (with cable 32 attached to it) from moving into the region of greater size 44. Thereby, the complete removal of stop member 42, cable 32 and therefore clothing 38 from the device 10 is prevented. If, after sampling clothing 38 a prospective purchaser wishes to buy same, a salesperson in possession of key 54 merely has to open lock 52, thereby moving locking bar 46 through aperture 58 into the body of the lock 52. This will free the stop member 42 to pass into the region of greater size 44 so that it can be removed from support member 18. Once that is done, the entire cable 32 can be removed from clothing 38 by passing stop member 42 through buttonhole 36.

Clearly, depending on the length of support member 18, any number of individual articles of clothing 38 can be separately secured to the device 10 by means of individual cables 32.

In alternate embodiments, there can be more than one support member 18 secured to upright member 16 so as to provide an almost limitless number of different configurations or arrays including the device of the invention.

Figure 5:
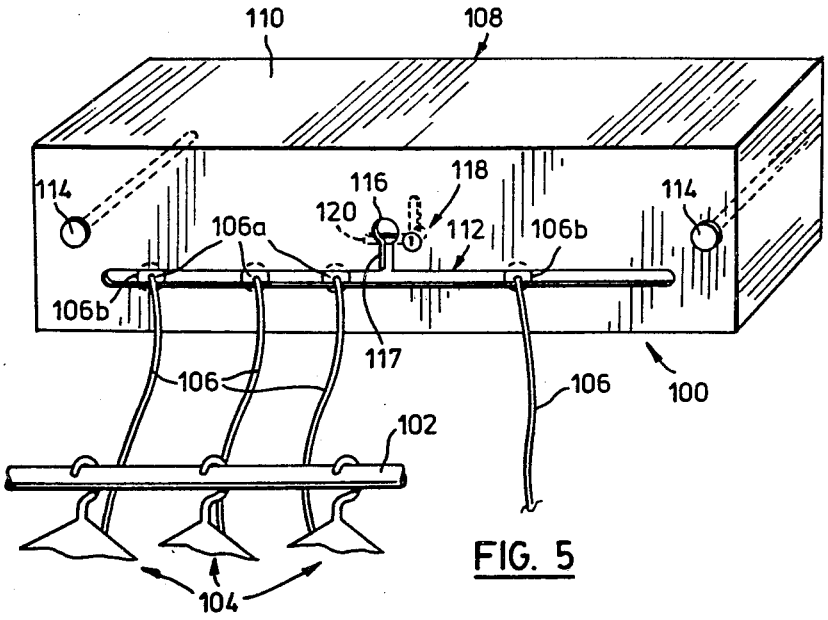
FIGS. 5 and 6 are perspective views of two forms of security device according to a further embodiment of the invention; and, FIGS. 7, 8 and 9 illustrate a further feature of the invention.
Figure 6:
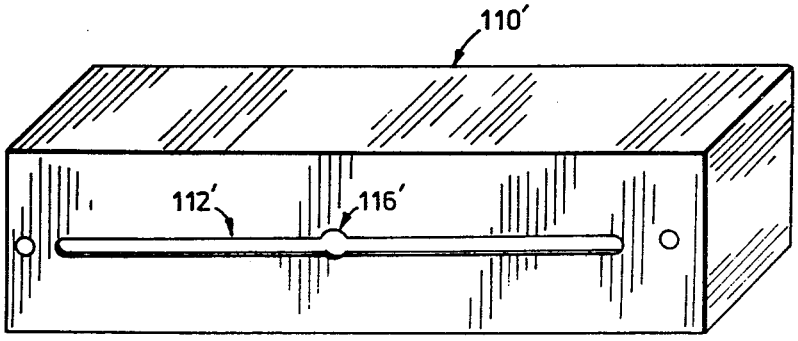

Reference will now be made to FIGS. 5 and 6 of the drawings in describing a further embodiment of the invention. In the embodiment of FIGS. 1 to 4, a garment incorporating a security device of the form provided by the invention was disclosed. In FIG. 5, a similar form of security device is disclosed as an independent unit. The device is generally indicated by reference numeral 100 and, for the purpose of illustration, is shown in association with a garment hanging rod 102 carrying garments 104. However, it is to be understood that this illustration is given by way of example only and that the security device may be used for any articles which are required to be secured while remaining manipulable with respect to the security device. Other examples of articles which would be secured by the device are sporting goods such as bicycles, rackets and the golf clubs in a sporting goods store. Further examples are handbags, purses and the like in a department store. While it is envisaged that the primary application of the invention will be in store displays, there is no limitation in this respect.

Referring now to FIG. 5 in more detail, the security device is shown as including a plurality of flexible elongate elements 106 and an anchor member 108. The anchor member is adapted to be secured in a fixed position and in this case is shown secured to a vertical wall surface although the member could be secured to any fixed support. In this embodiment, anchor member 108 comprises a generally rectangular box-shaped housing 110 having a front face formed with a horizontally extending elongate slot 112. The housing is shown secured to the supporting wall surface by two plain headed bolts 114 designed to be non-releaseable from the exterior of the device.

The flexible elements 106 are of essentially the same form as the elements described above in connection with the preceding embodiment and they will not therefore be described in detail here. For present purposes, it is sufficient to note that the elements have respective first end portions denoted 106*a* which are disposed serially in slot 112 and that each element is provided at its first end with an enlargement 106*b* which prevents the element being withdrawn through the slot. The slot is undercut to accommodate these enlargements by virtue of the fact that the housing 110 is hollow. In an alternative embodiment, this undercut could be provided by an appropriately shaped elongate recess or channel behind the slot. At their outer ends, the elements 106 are secured to the articles of clothing 104 again in the manner disclosed above in connection with FIGS. 1 to 4. Alternative methods for securing the articles to the flexible element are of course possible; for example, the elements could be looped through the arms of the garment and secured at their outer ends to the housing 110, or to some other suitable fixed point.

In any event, slot 112 is dimensioned to permit free sliding movement of the flexible elements along the slot and the anchor member further includes a release opening 116 disposed approximately mid-way between the ends of slot 112 and communicating therewith by way of a narrow neck slot portion 117 of the same width as slot 112. This slot portion extends outwardly from one edge (the upper edge) of slot 112 so that the bottom edge remains uninterrupted or free sliding movement of the flexible elements along the slot.

It has been found that positioning the release opening, as opening 116, intermediate the ends of the slot has the advantage that the flexible elements can be moved serially along the slot and past the release opening until a particular element to be released reaches the position of the opening. That element can then be individually moved into the release opening and withdrawn without the need to first remove preceding elements in the slot. FIG. 6 of the drawings illustrates a modification of the arrangement shown in FIG. 5 and primed reference numerals have been used to denote corresponding parts. In FIG. 6, the release opening 116' is disposed generally at the center of the slot and is in fact formed by two semicircular recesses above and below the slot. This arrangement has the same advantage as the arrangement shown in FIG. 5 but the FIG. 5 arrangement may be preferred where the slot is arranged in a vertical face of the anchor member because the lower edge of the slot can then remain uninterrupted, making for ease of free sliding movement of the elongate elements along the slot. Of course, in both embodiments, two or more release openings could be provided for the same slot and would be disposed in spaced positions along the slot.

Referring back to FIG. 5, the security device includes a cylinder-type key lock 118 which is essentially the same as the lock in the embodiment of FIGS. 1 to 4 except in that the lock cylinder has an axial projection at its rear side (not visible in FIG. 5) which is fitted with a radial lock member, denoted 120 arranged to move angularly through approximately 90° when the lock is operated by a suitable key (not shown). The lock is arranged so that lock member is movable between a locking position in which it is shown in dotted lines in FIG. 5 in which the slot portion 117 is obstructed, and a release position, indicated in chain dotted outline, permitting movement of the elongate elements into the release opening.

Figure 7:
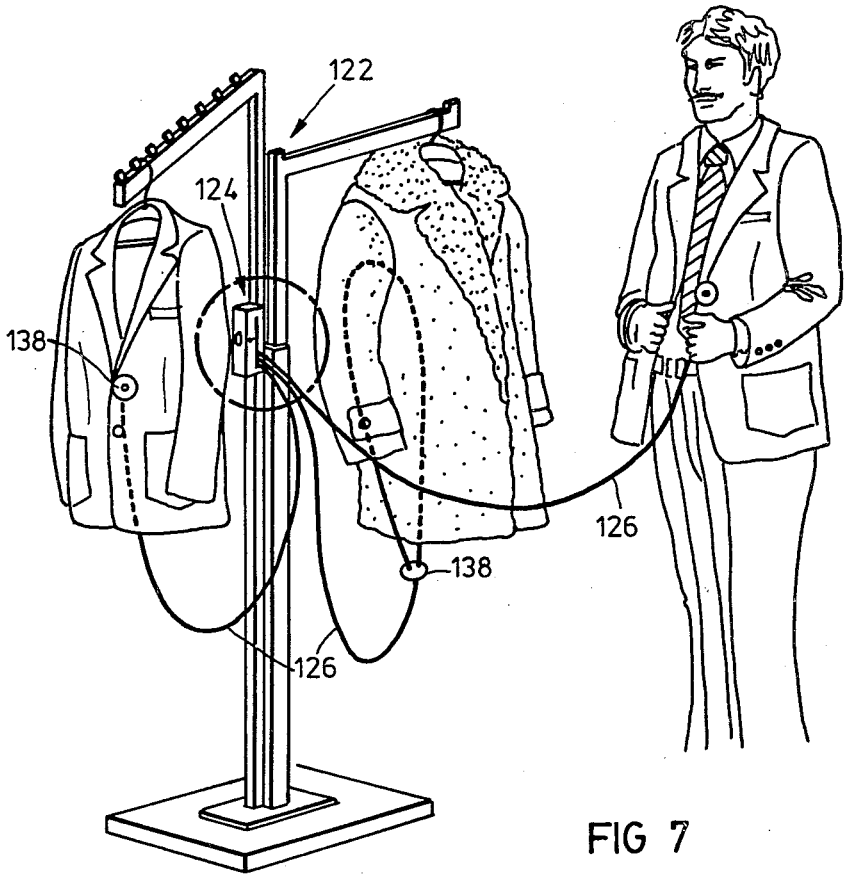
Figure 8:
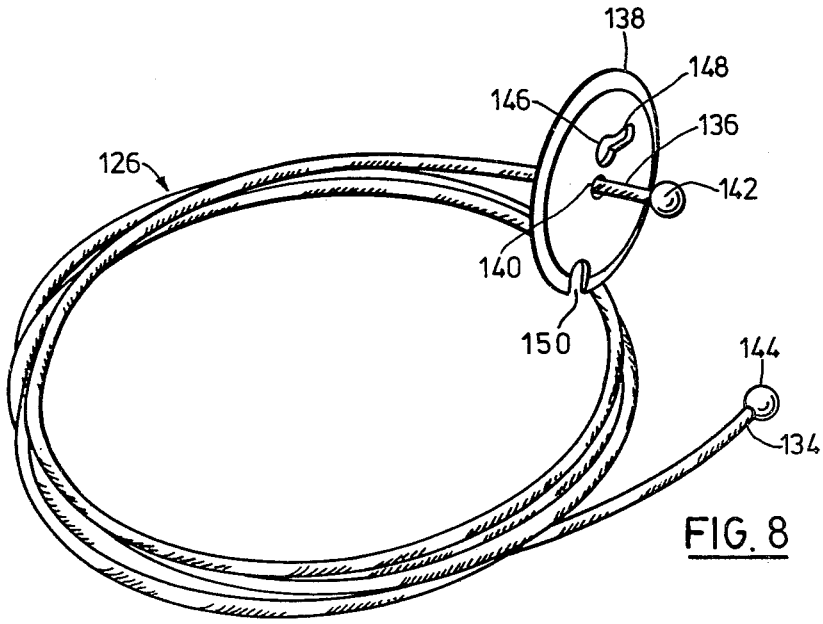
Figure 9:
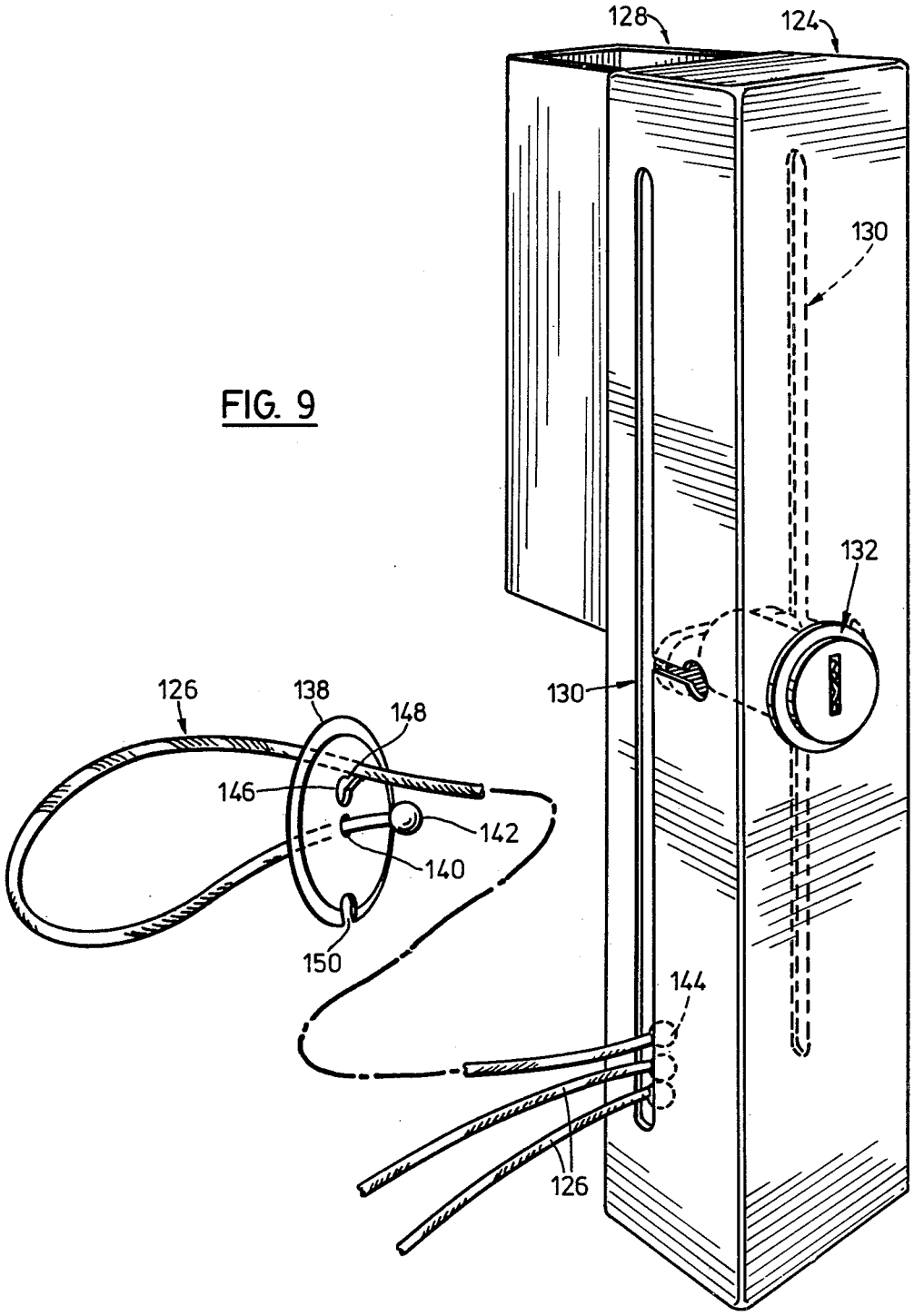

FIGS. 7, 8 and 9 illustrate a further feature of the invention and will now be described.

FIG. 7 is a perspective view of a garment stand 112 fitted with a security device 124. Device 124 takes the form of an independent unit and is generally somewhat similar to the device 108 shown in FIG. 5. Device 124 could be secured to any suitable support but in this embodiment it is shown secured to an upright of stand 122. The device retains a number of flexible elongate elements 126, one of which is shown individually in FIG. 8. FIG. 9 is an enlargement of the security device itself, but oriented somewhat differently from the orientation of FIG. 7. Except for the security device 124, garment stand 122 is essentially conventional.

Device 124 as shown in FIG. 9 is essentially very similar to the device shown in FIG. 5 and will not therefore be described in detail. It is sufficient to note that the device is fitted at one side with a tubular member 128 which embraces the upright of stand 122 and by which the device is secured to the stand. Also, device 124 is provided in each side with a slot which is denoted 130 in FIG. 9 but which is essentially the same as the slot 112 of FIG. 5. Access to the two slots is simultaneously controlled by a single lock 132.

As indicated previously, FIG. 8 shows one of the flexible elongate elements 126 which are used in association with the security device 124. In this embodiment, the element takes the form of a plastic-coated flexible steel cable having a first end portion 134 which is normally retained in the security device and a second, outer end portion 136. A nylon disc 138 is retained on element 126 adjacent its outer end. In this case, element 126 extends through a central opening 140 in the disc and is provided at its outer end with an enlargement 142. A similar enlargement 144 is provided at the first end of the element as in the preceding embodiments. The two enlargements 142 and 144 are in this case formed by soldered metal balls at the ends of the cable.

Disc 138 is provided with an opening 146 which is sized to permit enlargement 144 to pass through the opening when element 126 is separate from the security device. This allows the element to be used in a looped or unlooped configuration as illustrated in FIG. 7. In that view, one of the elements 126 is shown in an unlooped configuration at the lefthand side of the view while another element 126 is shown in a looped configuration at the righthand side. In the unlooped configuration, element 126 is passed through the buttonhole of the garment and then attached to the security device so that the disc 138 prevents the element being drawn through the buttonhole and the garment removed. In the looped configuration the element is passed through an arm of the garment as shown and then back through the opening 146 in disc 138 and connected to the security device so that, again, the garment is retained. It will of course be understood that the element can be used in other ways in both its looped and unlooped configurations and that FIG. 7 merely illustrates two possible examples where the security device is being used in association with a garment stand.

In the illustrated embodiment, the opening 146 in disc 138 is generally of keyhole shape and defines a recess 148 which is generally parallel-sided and which dimensioned to permit element 126 to be frictionally retained in the recess as best shown by FIG. 9. In this way, the extent of the loop formed in the cable can be determined and retained, which is desirable from the viewpoint of tidiness but which is not of course essential to the function of disc 138.

Disc 138 is also formed with a recess 150 which opens into the peripheral surface of the disc and which is dimensioned as recess 148 to receive and frictionally retain a portion of element 126 inserted into the recess. This allows any slack in element 126 to be taken up by appropriately looping the element and engaging a portion thereof in recess 150.

It will of course be appreciated that the preceding description relates to preferred embodiments of the invention only and that many modifications are possible within the broad scope of the invention. For example, the particular form of lock described is not of course essential. Combination locks could of course be used. Also, the flexible elements need not be cables; chains or other suitable elements could be employed as alternatives. A single anchor member could be provided with more than one slot, each receiving a number of flexible elongate elements and having an associated slot. In the embodiment of FIG. 5, the length of the neck slot portion 117 may of course vary; opening 116 could in fact be formed directly in one side of the slot.

In the embodiment of FIGS. 7, 8 and 9, article securing members of other forms may of course be used; the member need not be disc-shaped. Also, while the member is preferably made of a plastic material, again this is not essential.

Flexible elements of the form disclosed with reference to FIGS. 7, 8 and 9 may be used both with security devices of the preceding embodiments and with devices other than those specifically disclosed herein.

I claim:

1. A security device comprising:

a plurality of flexible elongate elements each adapted to retain at least one article to be secured;

an anchor member for said flexible elements, said member being adapted to be secured in a fixed position and including an elongate undercut slot extending longitudinally of the member;

said flexible elements having first end portions serially disposed in said slot, with the remainder of each element extending outwardly from said member and being of a length sufficient to permit the articles to be individually manipulated with respect to said member while remaining secured thereto by said elements, each said flexible element having an enlargement at its first end and said slot being dimensioned to permit free sliding movement of the flexible elements along the slot while preventing movement of the enlargements through the slot, said anchor member further including a release opening which communicates with said slot and which is of a size sufficient to permit movement of any of said enlargements therethrough so that the associated elongate element can be released from the anchor member;

lock means coupled to said anchor member and including a lock member moveable between a locking position in which the member prevents movement of said elements from said slot to said release opening, and a release position permitting such movement of the elongate elements, said lock means being releasable to permit movement of said lock member to said release position when authorized removal of articles is to be permitted;

and wherein at least one of said flexible elements further includes an article securing member retained on the element adjacent a second end thereof, said member defining an opening through which said enlargement at the first end of the member can pass when the element has been released from the anchor member to form a loop in said element, whereby the element can be used selectively in a looped or unlooped configuration for retaining an article, said opening defining a narrow generally parallel-sided recess dimensioned to permit a portion of said element to be frictionally retained in said recess.

2. A device as claimed in claim 1, wherein said opening is generally key-hole shaped.

3. A device as claimed in claim 1, wherein said article securing member additionally includes a similar parallel-sided recess in a peripheral edge of said member in which a portion of said element can be frictionally retained.

4. A device as claimed in claim 1, wherein said article securing member is a nylon disc.

5. A device as claimed in claim 1, wherein said release opening is disposed intermediate the ends of the slot in the anchor member so that the elongate elements in said slot can be moved serially past said opening until a predetermined element to be released from said anchor member reaches the position of the opening, whereby that element can be released without the need to first release preceding elements in said slot.

6. A device as claimed in claim 5, wherein said release opening is spaced from said slot and communicates therewith by way of a neck slot portion of substantially the same width as said slot extending outwardly from an edge of the slot to said release opening, whereby the opposite edge of the slot is unobstructed for facilitating free sliding movement of the flexible elements along the slot.

7. The combination of a security device as claimed in claim 1 and a display stand for articles of clothing and the like, whereby articles displayed on said stand can be secured by said security device.

8. The invention of claim 7, wherein said display stand includes a base and an upright member extending generally vertically upwards from said base, and wherein said anchor member of the security device is secured to said upright member of the stand.

9. An article retaining assembly for use with a security device comprising a flexible elongate element having a first end portion provided with an enlargement adapted to be retained by the security device, the remainder of the element being of a length sufficient to permit an article to be manipulated with respect to the device while remaining secured thereto by said element, and an article securing member retained on the element adjacent a second end thereof, said member defining an opening through which said enlargement can pass whereby the element can be used in a looped or unlooped configuration to retain an article secured by the device, said opening defining a narrow generally parallel-sided recess dimensioned to permit a portion of said element to be frictionally retained in said recess.

* * * * *